US006160466A

United States Patent [19]

Kawai

[11] Patent Number: 6,160,466

[45] Date of Patent: Dec. 12, 2000

[54] ELECTRIC NOISE ABSORBER

[75] Inventor: Hideharu Kawai, Nagoya, Japan

[73] Assignee: Kitagawa Industries Co., Ltd., Nagoya, Japan

[21] Appl. No.: 09/322,949

[22] Filed: May 28, 1999

[30] Foreign Application Priority Data

Jun. 8, 1998 [JP] Japan ..... 10-159192

[51] Int. Cl.[7] ..... H01F 17/06; H01F 27/02

[52] U.S. Cl. ..... 336/176; 336/92; 336/212

[58] Field of Search ..... 336/92, 176, 212; 174/92; 333/12, 181

[56] References Cited

U.S. PATENT DOCUMENTS

| | | | |
|---|---|---|---|
| 5,373,277 | 12/1994 | Naito | 336/92 |
| 5,703,557 | 12/1997 | Osada et al. | 336/92 |
| 5,764,125 | 6/1998 | May | 336/92 |
| 5,900,796 | 5/1999 | Parker | 336/92 |
| 5,920,250 | 7/1999 | Watanabe et al. | 336/92 |
| 5,942,964 | 8/1999 | Takeuchi | 336/92 |

FOREIGN PATENT DOCUMENTS

| | | |
|---|---|---|
| 289807 | 7/1990 | Japan . |
| 529152 | 2/1993 | Japan . |

*Primary Examiner*—Michael L. Gellner
*Assistant Examiner*—Anh Mai
*Attorney, Agent, or Firm*—Davis and Bujold

[57] ABSTRACT

An electric noise absorber provided with first, second and third magnetic body parts in first, second and third housing sections, respectively. Grooves are provided to form a first hollow in which an electric wire is placed between the first and second magnetic body parts when the magnetic body parts are connected by abutting faces. Moreover, grooves are provided to form a second hollow in which an electric wire is placed between the second and third magnetic body parts when the magnetic body parts are connected by abutting faces. The electric wire is wound desired times around the second housing section with the second magnetic body housed therein along the grooves in the opposite faces of the second magnetic body, and the first and third housing sections are closed, so that the electric noises flowing through the electric wire can effectively be absorbed.

19 Claims, 9 Drawing Sheets

ELECTRIC NOISE ABSORBER

BACKGROUND OF THE INVENTION (i) Field of the Invention

The present invention relates to an electric noise absorber which is attached around an electric wire of electronic apparatus to absorb electric noises generated inside the electronic apparatus or electric noises transmitted to the electronic apparatus from the outside via the electric wire.

(ii) Description of the Related Art

In a conventional art for removing or suppressing electric noises flowing through the electric wire, a magnetic body, for example, of ferrite is attached around the electric wire to attenuate the electric noises flowing through the wire. Examples of such known electric noise absorber include a non-divided type absorber in which an annular closed magnetic path is formed only by a magnetic body, a divided type absorber in which the closed magnetic path is formed when the electric wire is surrounded with a plurality of divided magnetic body parts, and the like. When an annular magnetic flux is generated by electric noises in the closed magnetic path formed by the magnetic body, the electromagnetic energy of the electric noise is converted to a heat energy inside the magnetic body. As a result, the electric noises are attenuated. When the electric wire is wound around the magnetic body in such a manner that the electric wire passes plural times inside the closed magnetic path formed by the magnetic body, i.e., a hollow in the magnetic body, the electric noises can more effectively be absorbed.

However, the number of windings of the electric wire passed through the hollow of the magnetic body is limited by the relationship between the thickness of the electric wire and the size or thickness of the hollow formed in the magnetic body. The electric noise absorbing performance cannot be enhanced further. The ability of preventing the operation error or failure of the electronic apparatus from being caused by the electric noises is also limited.

SUMMARY OF THE INVENTION

Wherefore, an object of the present invention is to provide an electric noise absorber which can effectively absorb electric noises.

According to a first aspect of the invention, there is provided an electric noise absorber comprising a magnetic body having a first and second openings extending therethrough to encompass an electric wire serially extending through the first and second openings to absorb electric noise flowing though the wire. Preferably, the first and second openings are disposed in parallel; the magnetic body comprises a plurality of magnetic body parts defining abutting faces, dividing at least one of the openings to define two open faced hollows together forming the opening, by which the parts may be joined to form the magnetically unitary magnetic body; and the parts comprise at least two different magnetic materials.

Each of the first and second openings may be divided into two open faced hollows by magnetic body parts having abutting faces by which the associated body parts may be joined as specified.

Also according to the invention, there is provided an electric noise absorber comprising a magnetic body defined by at least two magnetic body parts which together define parallel openings spaced by magnetic material of at least one of the parts, through which openings an electric wire may extend in series for absorption of electric noise, flowing through the wire, by the absorber, the parts defining abutting faces by which the body parts may be joined to form the magnetically unitary magnetic body.

Preferably, there are three magnetic body parts and the openings are spaced by one of these body parts which defines abutting faces by which the three body parts are joined as specified; and housing parts housing the body parts connectable together ensure the joining of the body parts at the abutting faces to ensure the formation of the magnetically unitary magnetic body.

The magnetic body is preferably formed of a ferrite of a nickel—zinc (Ni—Zn) material or a manganese—zinc (Mn—Zn) material. A soft or hard ferrite can be used. Instead of using the ferrite itself, ferrite powder may be mixed in plastic, synthetic rubber, or the like. Besides the ferrite body, a silicon steel magnetic core, a powder compact of molybdenum or other metal, or the like may be used as the magnetic body. The material of the magnetic body is not limited to these examples.

According to further aspect of the present invention, the electric noise absorber is provided with a plurality of magnetic body parts formed of different magnetic materials. Each of the magnetic body parts is provided with the hollow. Specifically, since the magnetic materials differ with the magnetic body parts, the frequency characteristic of the electric noise absorbing performance can differ with the magnetic body parts and the electric noise absorbing characteristic is enhanced over a wide bandwidth.

BRIEF DESCRIPTION OF THE DRAWINGS

The invention will now be described, by way of example, with reference to the accompanying drawings, in which.

DETAILED DESCRIPTION OF PREFERRED EMBODIMENTS

Embodiments of the present invention will be described hereinafter with reference to the accompanying drawings.

A. A first embodiment of the invention will now be described.

Figure 1A:
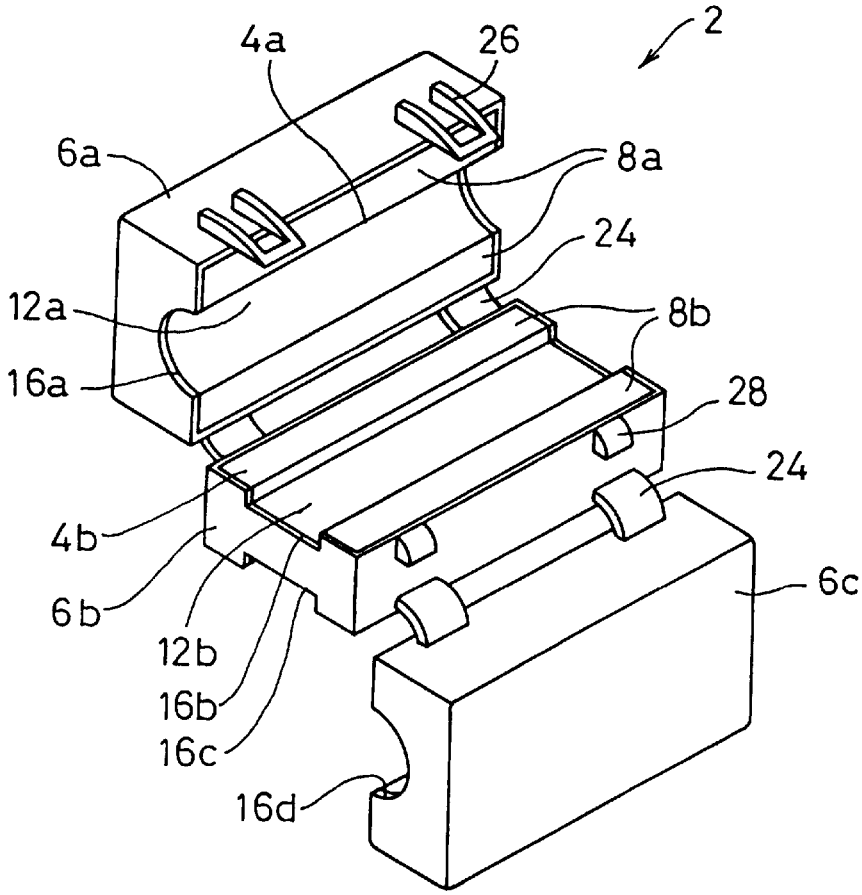
FIGS. 1A and 1B are explanatory views showing the structure of an electric noise absorber according to the first embodiment of the present invention.
Figure 1B:
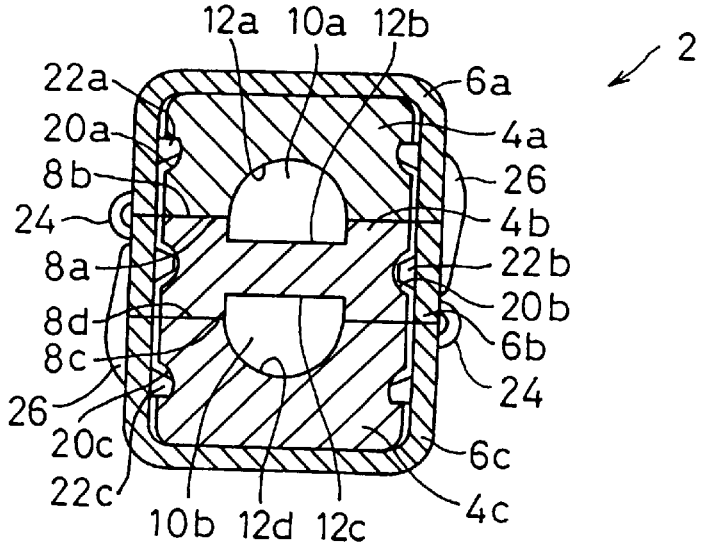

FIGS. 1A and 1B are explanatory views showing the structure of an electric noise absorber 2 according to the first embodiment of the present invention. The electric noise absorber 2 is provided with a magnetic body 4 and its support casing. The magnetic body is divided into three pieces. Specifically, the magnetic body 4 is formed of a first magnetic body part 4*a*, a second magnetic body part 4*b* and a third magnetic body part 4*c*. The magnetic body parts are collectively termed the magnetic body 4. The magnetic body parts 4*a*, 4*b* and 4*c* are contained in first, second and third housing sections 6*a*, 6*b* and 6*c*, respectively. For material, Mn—Zn soft ferrite is used in the first magnetic body part 4*a*, while Ni—Zn soft ferrite is used in the second and third magnetic body parts 4*b*, 4*c*.

Abutting faces 8*a*, 8*b* which can abut each other without any gap therebetween are formed in an area where the first and second magnetic body parts 4*a* and 4*b* are opposed. Grooves 12*a*, 12*b* are formed in the magnetic body parts 4*a*, 4*b*, respectively, to form a first hollow 10*a* in which an electric wire may be positioned between the magnetic body parts when the magnetic body parts are interconnected without any gap therebetween by the abutting faces 8*a*, 8*b*. Abutting faces 8*c* are also formed opposite to the abutting faces 8*b* of the second magnetic body part 4*b*, and abutting faces 8*d* are formed on the third magnetic body part 4*c*. Grooves 12*c*, 12*d* are formed in the magnetic body parts 4*b*, 4*c*, respectively, to form a second hollow 10*b* in which an electric wire is positioned between the magnetic body parts 4*b* and 4*c* when the second and third magnetic body parts 4*b*, 4*c* are interconnected without any gap by the abutting faces 8*c*, 8*d*. The magnetic body parts 4*a* to 4*c* are provided with recesses 20*a* to 20*c* to engage the inner walls of the housing sections 6*a* to 6*c* when the magnetic body parts 4*a* to 4*c* are housed in the housing sections 6*a* to 6*c*, respectively.

Each of the first and third housing sections 6*a*, 6*c* is a box shape having an opening via which each of the first and third magnetic body parts 4*a*, 4*c* are contained, respectively. The inner walls of the first and third housing sections 6*a*, 6*c* are provided with fixed protrusions 22*a*, 22*c* which can engage the recesses 20*a*, 20*c* of the first and third magnetic body parts 4*a*, 4*c*, respectively. When the first and third magnetic body parts 4*a*, 4*c* are housed in the first and third housing sections 6*a*, 6*c* in such a manner that the abutting faces 8*a*, 8*d* are exposed, the fixed protrusions 22*a*, 22*c* engage in the recesses 20*a*, 20*c* to prevent the first and third magnetic body parts 4*a*, 4*c* from falling out of the housing sections 6*a*, 6*c*, respectively.

The second housing section 6*b* is a substantially square frame shape which encompasses the side wall of the second magnetic body part 4*b* and has openings via which the second magnetic body part 4*b* can be inserted. The inner wall of the second housing section 6*b* is also provided with a fixed protrusion 22*b* which engages the recess 20*b* of the second magnetic body part 4*b*. When the second magnetic body part 4*b* is housed in the second housing section 6*b* to expose the abutting faces 8*b*, 8*c*, the fixed protrusion 22*b* engages the recess 20*b* to prevent the second magnetic body part 4*b* from falling out of the second housing section 6*b*.

Additionally, notches 16*a* to 16*d* are formed in the housing sections 6*a* to 6*c* through which the electric wire can be passed and corresponding to the sectional shapes of the grooves 12*a* to 12*d* when the magnetic body parts 4*a* to 4*c* are housed in the housing sections 6*a* to 6*c*, respectively.

The first and third housing sections 6*a* and 6*c* are openably connected to the second housing section 6*b* by two pairs of hinges 24. Each pair of hinges 24 are arranged on the opposite outer surfaces of the second housing section 6*b* at upper and lower positions thereon, respectively. When the first and third housing sections 6*a* and 6*c* can rotate about the hinges 24, and the openings in the second housing section 6*b* can be closed by the first and third housing sections 6*a* and 6*c*. Therefore, when the first and third housing sections 6*a* and 6*c* are closed while the magnetic body parts 4*a* to 4*c* are housed in the housing sections 6*a* to 6*c*, respectively, the first and second magnetic body parts 4*a* and 4*b* are interconnected via the abutting faces 8*a*, 8*b* to form the first hollow 10*a*, and a closed magnetic path is formed around the hollow 10*a*. Then, the second and third magnetic body parts 4*b* and 4*c* are interconnected via the abutting faces 8*c*, 8*d* to form the second hollow 10*b*, and a closed magnetic path is formed around the hollow 10*b*. Moreover, the opening edges of the first and third housing sections 6*a* and 6*c* opposite to the hinges 24 are provided with engaging frames 26, while the opening edges of the second housing section 6*b* opposite to the hinges 24 are provided with protrusions 28 which can engage in the engaging frames 26 when the first and third housing sections 6*a* and 6*c* are closed. The frames 26 and protrusions 28 form resilient latches. Therefore, when the first and third housing sections 6*a* and 6*c* are closed, the engaging frames 26 are locked by the protrusions 28 and the first and third magnetic body parts 4*a* and 4*c* abut closely the second magnetic body part 4*b*.

Figure 2A:
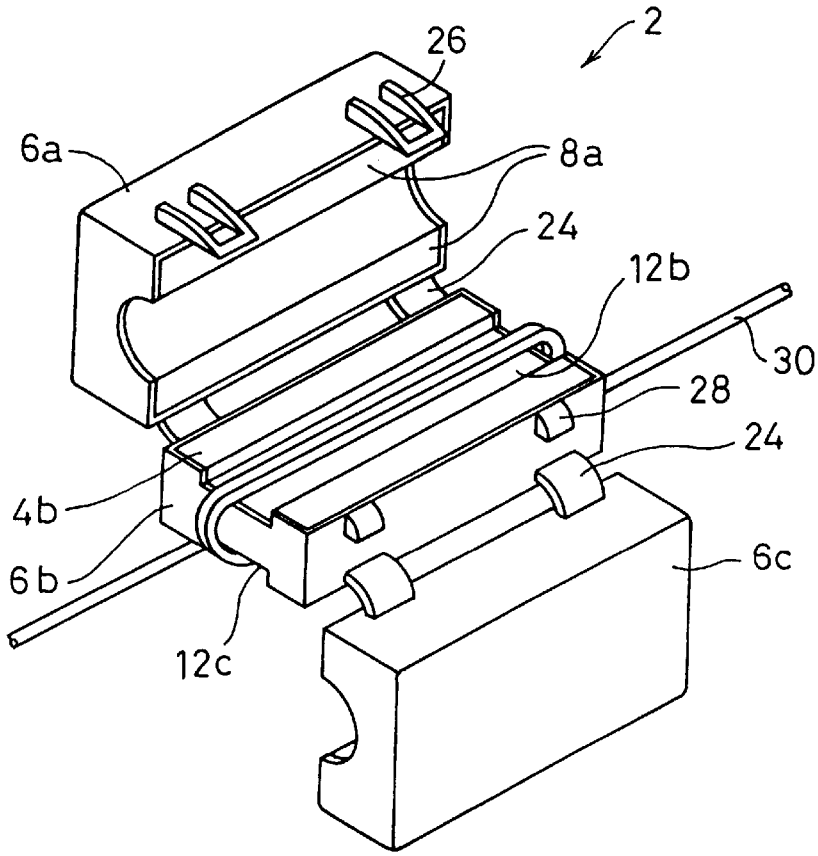
FIGS. 2A and 2B are schematic views showing the state of the electric noise absorber of FIGS. 1A and 1B when in use.
Figure 2B:
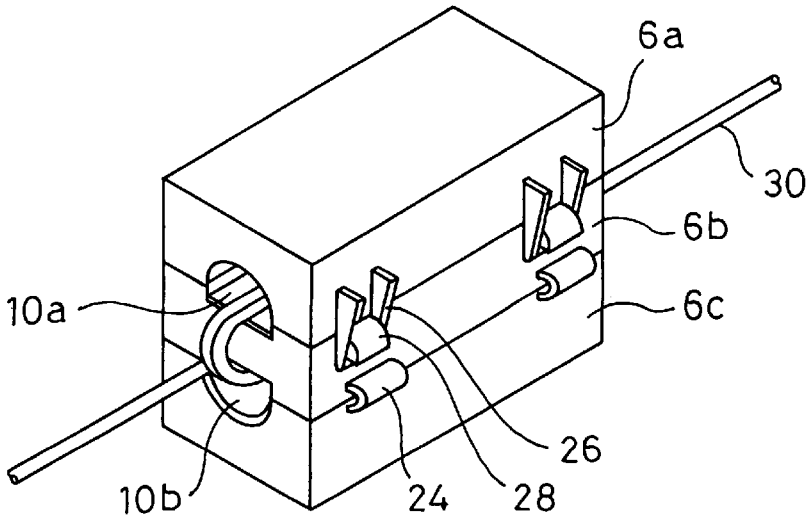

In use the electric noise absorber 2 having the abovementioned structure, the electric wire 30 is wound a desired times around the periphery of the second housing section 6*b* with the second magnetic body part 4*b* housed therein, along the grooves 12*b* and 12*c* formed in opposite surfaces of the second magnetic body part 4*b* as shown in FIG. 2A. Then, the first and third housing sections 6*a* and 6*c* are closed onto housing section 6*b*. The engaging frames 26 are engaged with the protrusions 28 so that the electric noise absorber 2 is attached to the electric wire as shown in FIG. 2B.

The electric noise absorber 2 of the first embodiment is provided with the first and second hollows 10*a* and 10*b* through which the electric wire 30 passes. By winding the electric wire 30 around the second magnetic body part 4*b* between the hollows 10*a* and 10*b*, the electric wire 30 is passes through the hollows 10*a* and 10*b* a plurality of times and the portion of the electric wire 30, which is exposed to the outside of the conventional electric noise absorber, is surrounded by the magnetic body parts. As a result, the electric noise flowing through the electric wire is absorbed more effectively than in the prior art. As a result, the operation error or failure of the electronic apparatus attributed to electric noises is greatly reduced.

Additionally, the electric noise absorber 2 can easily be attached to an already placed electric wire by winding the wire around the second magnetic body part 4*b* and subsequently closing the first and third magnetic body parts 4*a* and 4*c*.

As the first magnetic body part 4*a* is formed of Mn—Zn ferrite, while the second and third magnetic body parts 4*b* and 4*c* are each formed of Ni—Zn ferrite, the electric noise absorbing ability of the electric noise absorber 2 is enhanced and extends over a wide bandwidth.

In order to confirm the above-mentioned effect, the following experiment was conducted.

Figure 8A:
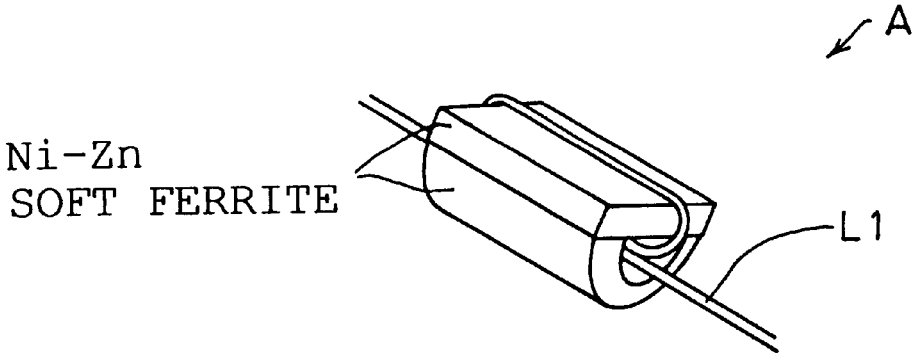
FIGS. 8A to 8C show samples for use in measuring the impedance-frequency characteristic.
Figure 8B:
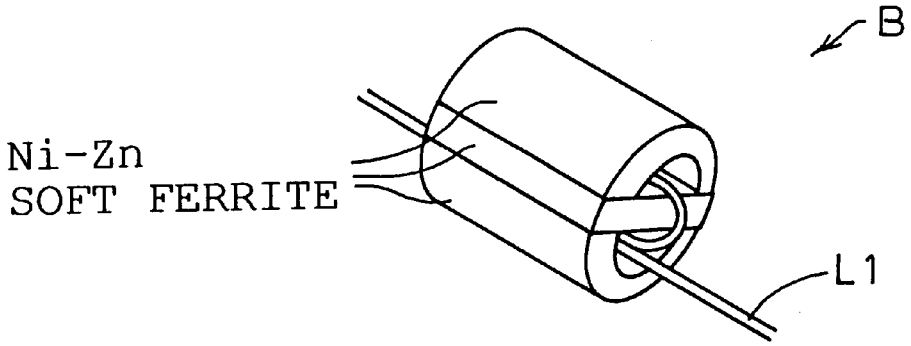
Figure 9A:
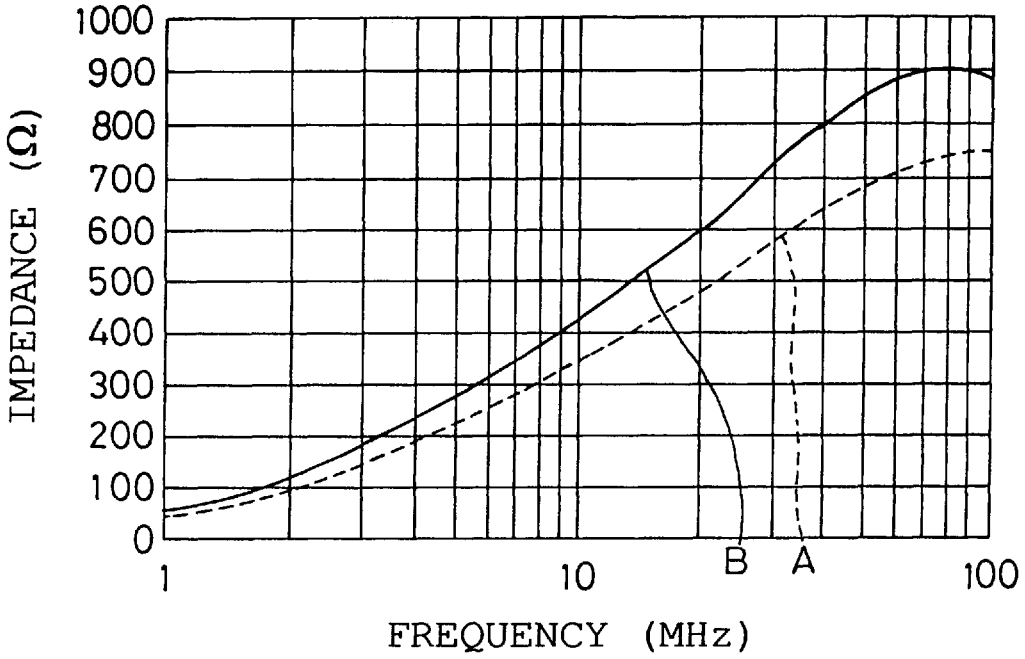
FIGS. 9A and 9B are graphs showing the impedance-frequency characteristic to compare the samples shown in FIGS. 8A to 8C.

As shown in FIG. 8A, there was prepared sample A of the conventional type electric noise absorber provided with only one hollow and wound with an electric wire L1 exposed on the outer periphery of a magnetic body. As shown in FIG. 8B, the inventors prepared sample B by bonding semicylindrical magnetic body parts to both surfaces of a magnetic body formed in a plate shape to form a magnetic body with two hollows arranged in parallel and by winding the electric wire L1 the same times as in sample A around the plate-shaped magnetic body between the hollows to pass the wire through both hollows. The impedance-frequency characteristic of both sample A and B were measured in a range of 1 MHz to 100 MHz. The results are shown graphically in FIG. 9A with the impedance characteristic of sample A being shown by a broken line and the impedance characteristic of sample B being shown by a solid line. Although the same number of turns of electric wire is wound around samples A and B, sample B is superior to the sample A in electric noise absorbing ability. Each of the magnetic body parts of sample A and B, shown in FIGS. 8A and 8B, is formed of nickel—zinc soft ferrite.

Figure 8C:
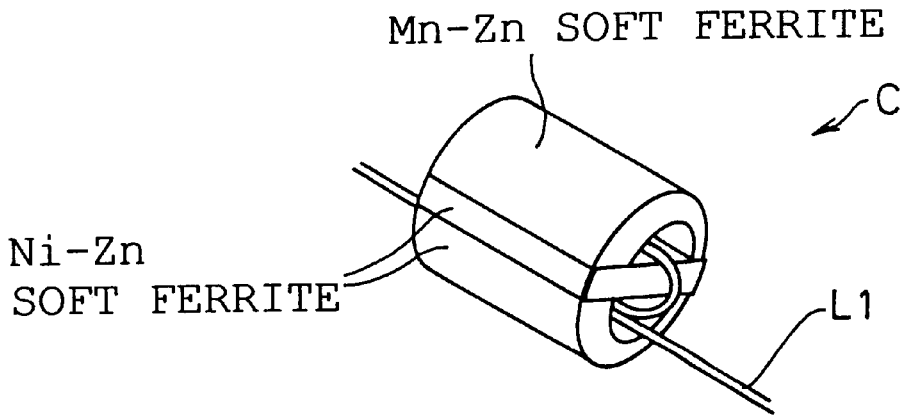
Figure 9B:
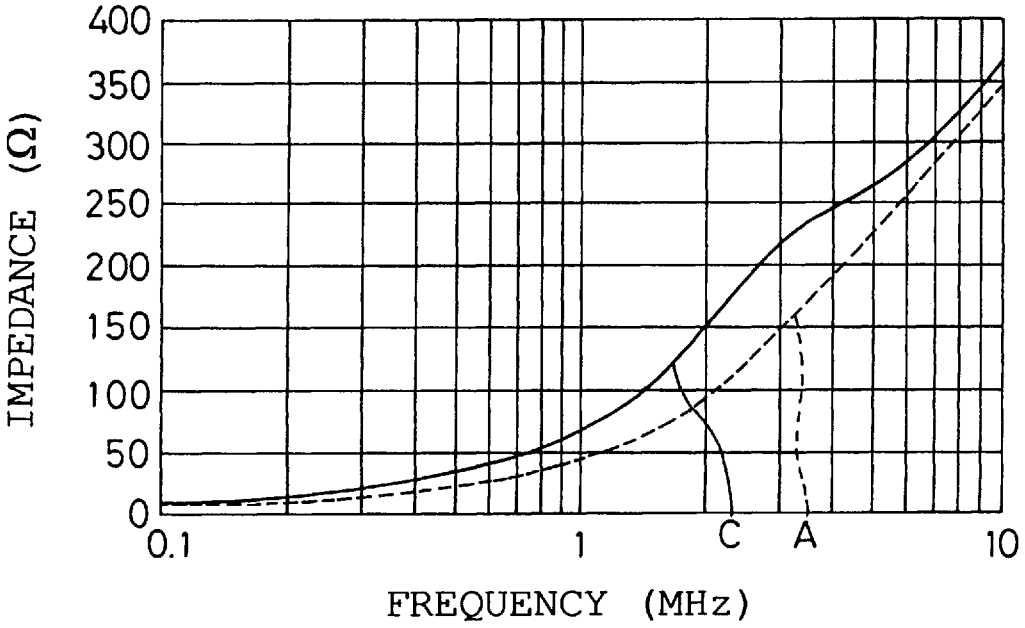

Subsequently, as shown in FIG. 8C, the Ni—Zn soft ferrite of one semi-cylindrical magnetic body part of sample B was replaced by Mn—Zn soft ferrite to form sample C. The impedance-frequency characteristic of the sample C was measured. As a result, as shown in FIG. 9B, the impedance was further raised in the range of 1 MHz to 8 MHz. It is thus confirmed that low-frequency electric noise can be absorbed more effectively. Specifically, when the first magnetic body part 4*a* is formed of Mn—Zn ferrite, while the second and third magnetic body parts 4*b* and 4*c* are each formed of Ni—Zn ferrite, the electric noise absorbing ability of the electric noise absorber 2 is enhanced over a wide bandwidth.

B. A second embodiment will now be described.

Figure 3A:
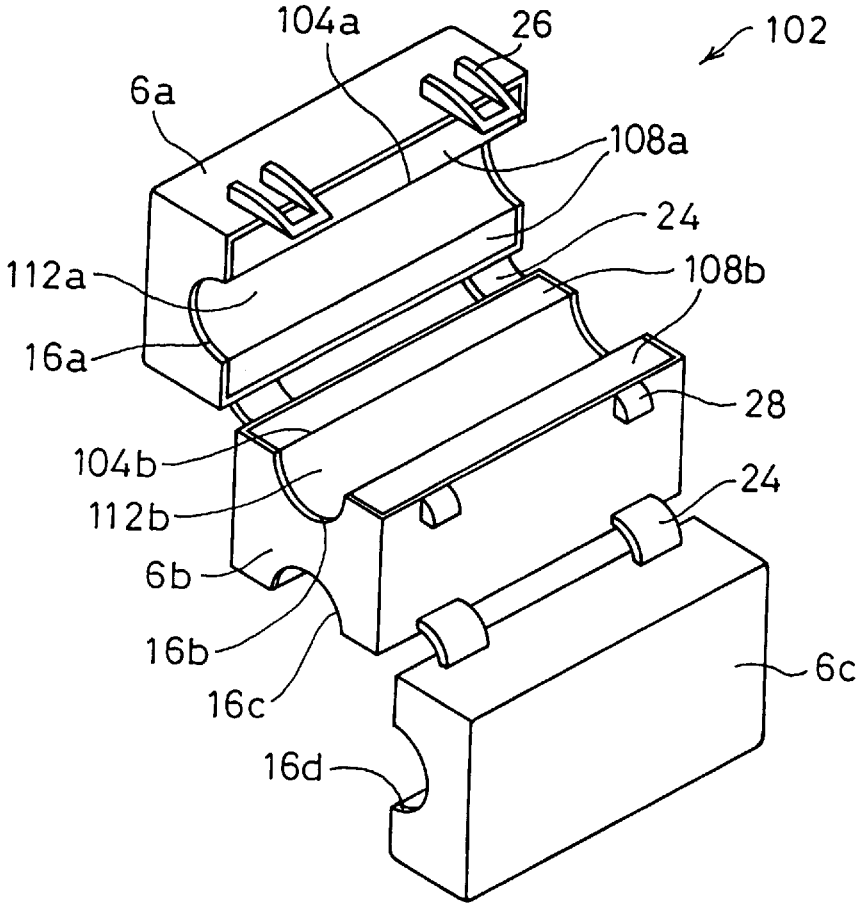
FIGS. 3A and 3B are explanatory views showing the structure of an electric noise absorber according to the second embodiment.
Figure 3B:
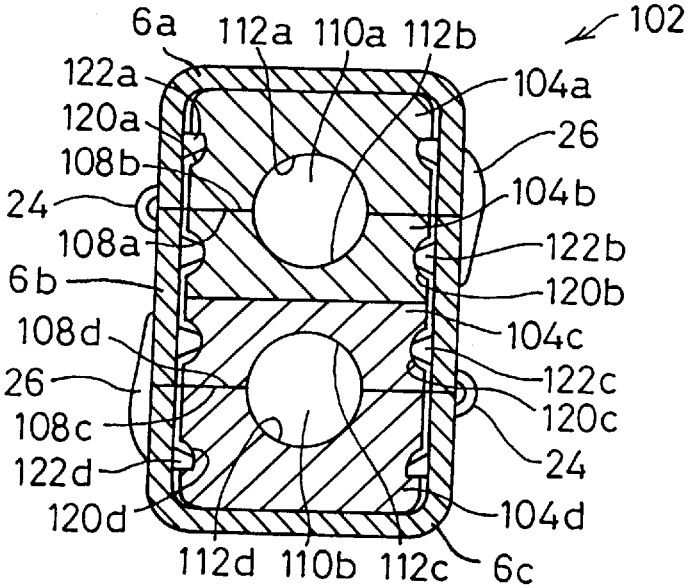

FIGS. 3A and 3B are explanatory views showing the structure of an electric noise absorber 102 according to the second embodiment. The electric noise absorber 102 is provided with first to third housing sections 6*a* to 6*c* and four divided magnetic body parts 104*a* to 104*d*. These parts together form the magnetic body 104. Mn—Zn soft ferrite is used in the first and second magnetic body parts 104*a* and 104*b*, while Ni—Zn soft ferrite is used in the third and fourth magnetic body parts 104*c* and 104*d*.

Abutting faces 108*a*, 108*b* which abut each other without any gap are formed where the first and second magnetic body parts 104*a* and 104*b* meet. Grooves 112*a*, 112*b* are formed in the magnetic body parts 104*a*, 104*b*, respectively, to form a first hollow 110*a* in which an electric wire is positioned when these magnetic body parts are interconnected without any gap between the abutting faces 108*a*, 108*b*. Abutting faces 108*c*, 108*d* which abut each other without any gap are formed in an area where the third and fourth magnetic body parts 104*c* and 104*d* meet. Grooves 112*c*, 112*d* are formed in the magnetic body parts 104*c*, 104*d*, respectively, to form a second hollow 110*b* in which an electric wire is positioned when these magnetic body parts are interconnected without any gap between the abutting faces 108*c*, 108*d*.

Magnetic body parts 104*a* and 104*d* are housed in first and second housing section 6*a* and 6*c*, respectively, while parts 104*b* and 104*c* are housed in third housing 6*b*. Recesses 120*a* to 120*d* are formed in the side walls of the magnetic body parts 104*a* to 104*d* to engage fixed protrusions 122*a* to 122*d* formed on the inner walls of the housing sections 6*a* to 6*c*, respectively.

Since the other structure of the second embodiment is the same as that of the first embodiment, the description thereof is omitted.

The electric noise absorber 102 constituted as aforementioned is attached to the electric wire as follows:

The magnetic body parts 104*a* to 104*d* are contained in the housing sections 6*a* to 6*c*, the electric wire is wound desired times around the periphery of the third housing section 6*b* along the grooves 112*b* and 112*c* of the second and third magnetic body parts 104*b* and 104*c*, and the first and second housing sections 6*a* and 6*c* are closed.

The magnetic body 104 is divided by the abutting faces extended through the hollows 110*a* and 110*b* in an axial direction.

Electric noise absorbing ability of the electric noise absorber 102 is enhanced over a wide bandwidth as with the first embodiment.

In the electric noise absorbers 2 and 102 of the first and second embodiments, the first hollows 10*a*, 110*a* and the second hollows 10*b*, 110*b* are formed by connecting the dividable magnetic body parts 4, 104, but the present invention is not limited to the embodiments. The magnetic body may be formed in such a manner that it cannot be divided and only one of a plurality of hollows need by formed by abutment faces.

C. A third embodiment will be described.

Figure 4A:
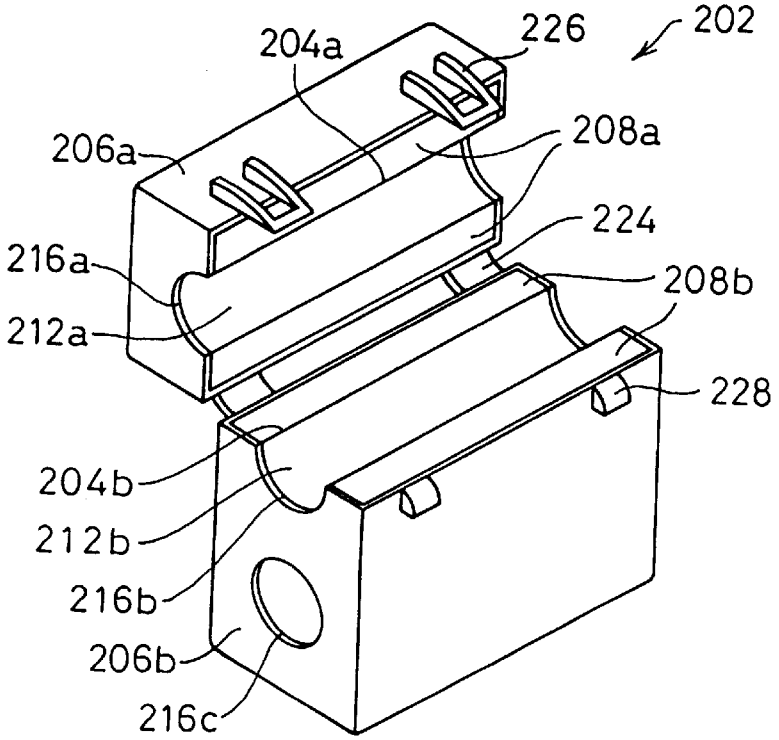
FIGS. 4A and 4B are explanatory views showing the structure of an electric noise absorber according to the third embodiment.
Figure 4B:
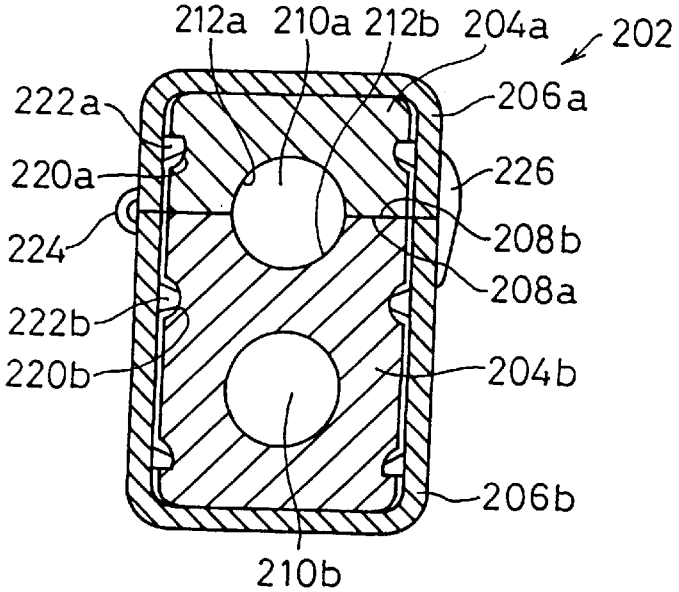

FIGS. 4A and 4B show the structure of an electric noise absorber 202 according to the third embodiment. The electric noise absorber 202 is provided with first and second magnetic body parts 204*a* and 204*b*, contained in first and second housing sections 206*a* and 206*b*, respectively. The first magnetic body 204*a* is formed of Mn—Zn soft ferrite, while the second magnetic body 204*b* is formed of Ni—Zn soft ferrite.

Abutting faces 208*a*, 208*b* which can abut on each other without any gap are formed in an area where the first and second magnetic body parts 204*a* and 204*b* meet. Grooves 212*a*, 212*b* are formed in the magnetic body parts to form a first hollow 210*a* in which an electric wire can extend between the magnetic body parts when the magnetic body parts are interconnected without any gap by the abutting faces 208*a*, 208*b*. Recesses 220*a*, 220*b* are formed in the side faces of the magnetic body parts 204*a*, 204*b* to engage with the inner walls of the housing sections 206*a*, 206*b*, respectively. A second hollow 210*b* is formed through the second magnetic body 204*b*.

The first and second housing sections 206*a* and 206*b* are formed as box shapes having openings via which the first and second magnetic body parts 204*a* and 204*b* can be contained, respectively. The inner walls of the housing sections are provided with fixed projections 222*a*, 222*b* which can captively engage the recesses 220*a*, 220*b* of the magnetic body parts 204*a*, 204*b*, respectively. When the first and second magnetic body parts 204*a* and 204*b* are housed in the first and second housing sections 206*a* and 206*b* in such a manner that the abutting faces 208*a*, 208*b* are exposed, the fixed protrusions 222*a*, 222*b* are engaged in the recesses 220*a*, 220*b* to prevent the magnetic body parts 204*a*, 204*b* from falling from the housing sections 206*a*, 206*b*, respectively.

Additionally, notches 216*a*, 216*b* are formed in the first and second housing sections 206*a* and 206*b* in such a manner that an electric wire can be passed corresponding to the sectional shapes of the grooves 212*a*, 212*b* when the first and second magnetic body parts 204*a* and 204*b* are housed therein, respectively. Insertion openings 216*c* via which the electric wire can be inserted are formed in the second housing section 206*b* corresponding to the second hollow 210*b* are formed in the second magnetic body 204*b*.

The first and second housing sections 206*a* and 206*b* are connected in the same manner as the first and second housing sections 6*a* and 6*b* of the first embodiment.

The electric noise absorber 202 constituted as aforementioned is attached to the electric wire by housing the magnetic body parts 204*a*, 204*b* in the housing sections 206*a*, 206*b*, respectively, winding the electric wire desired times around the second magnetic body 204*b* between the groove 212*b* and the second hollow 210*b* along the groove 212*b* and the second hollow 210*b* and closing the first housing section 206*a*.

The magnetic body is divided by the abutting faces extended through the first hollow 210*a* in the axial direction. The first hollow 210*a* is formed by connecting the first and second magnetic body parts 204*a* and 204*b*. The electric wire can be relatively easily wound around the second magnetic body 204*b*. Labor can thus be advantageously reduced.

In electric noise absorber 202 of the third embodiment, an abutting face extends in only one hollow.

D. A fourth embodiment will now be described.

Figure 5:
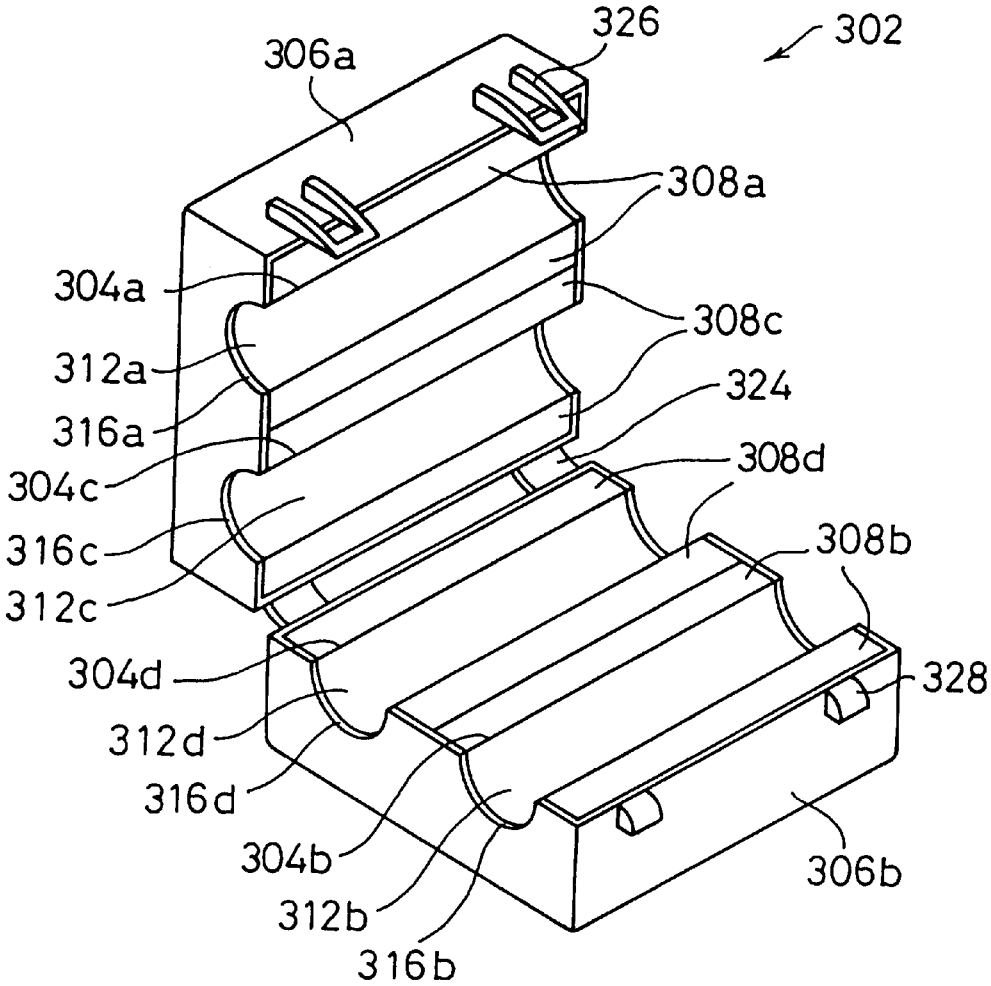
FIG. 5 is an explanatory view showing the structure of an electric noise absorber according to the fourth embodiment.

FIG. 5 shows the structure of an electric noise absorber 302 according to the fourth embodiment. The electric noise absorber 302 is provided with divided pieces, i.e., first and third magnetic body parts 304*a* and 304*c* in a first housing section 306*a* and second and fourth magnetic body parts 304*b* and 304*d* in a second housing section 306*b*. Mn—Zn soft ferrite is used in the first and second magnetic body parts 304*a* and 304*b*, while Ni—Zn soft ferrite is used in the third and fourth magnetic body parts 304*c* and 304*d*.

Abutting faces 308*a*, 308*b* which abut each other without any gap are formed in an area in which the first and second magnetic body parts 304*a* and 304*b* meet. Grooves 312*a* and 312*b* are formed in such a manner that a hollow can be formed in which an electric wire is positioned between the magnetic body parts 304*a* and 304*b* when the magnetic body parts are connected, without any gap therebetween, by the abutting faces 308*a*, 308*b*. Moreover, abutting faces 308*c*, 308*d* which can abut on each other without any gap are formed in an area in which the third and fourth magnetic body parts 304*c* and 304*d* are opposed to each other. Grooves 312*c* and 312*d* are formed in such a manner that a hollow can be formed in which an electric wire extends between the magnetic body parts 304*c* and 304*d* when the magnetic body parts are connected without any gap therebetween by the abutting faces 308*c*, 308*d*.

The first housing section 306*a* is formed in a box shape having an opening in which the first and third magnetic body parts 304*a* and 304*c* are arranged and housed, while the second housing section 306*b* is formed in a box shape having an opening in which the second and fourth magnetic body parts 304*b* and 304*d* are arranged and housed. The first and third magnetic body parts 304*a* and 304*c* are exposed in the opening of the first housing section 306*a* when housed in the first housing section 306*a* and the second and fourth magnetic body parts 304*b* and 304*d* are exposed in the opening of the second housing section 306*b* when housed in the second housing section 306*b*.

Notches 316*a* to 316*d* via which an electric wire can be passed are formed in the housing sections 306*a*, 306*b* corresponding to the sectional shapes of the grooves 312*a* to 312*d* when the magnetic body parts 304*a* to 304*d* are housed, respectively.

The first and second housing sections 306*a* and 306*b* are connected, hinged and latched closed in similar manner to the housing sections of the first, second and third embodiments.

The electric noise absorber 302 constituted as aforementioned is attached to the electric wire by housing the magnetic body parts 304*a* to 304*d* in the housing sections 306*a*, 306*b*, placing the electric wire in an annular state along the grooves 312*b*, 312*d* of the second and fourth magnetic body parts 304*b* and 304*d*, respectively, or the grooves 312*a*, 312*c* of the first and third magnetic body parts 304*a* and 304*c*, respectively, and connecting the first and second housing sections 306*a* and 306*b* together.

Figure 6A:
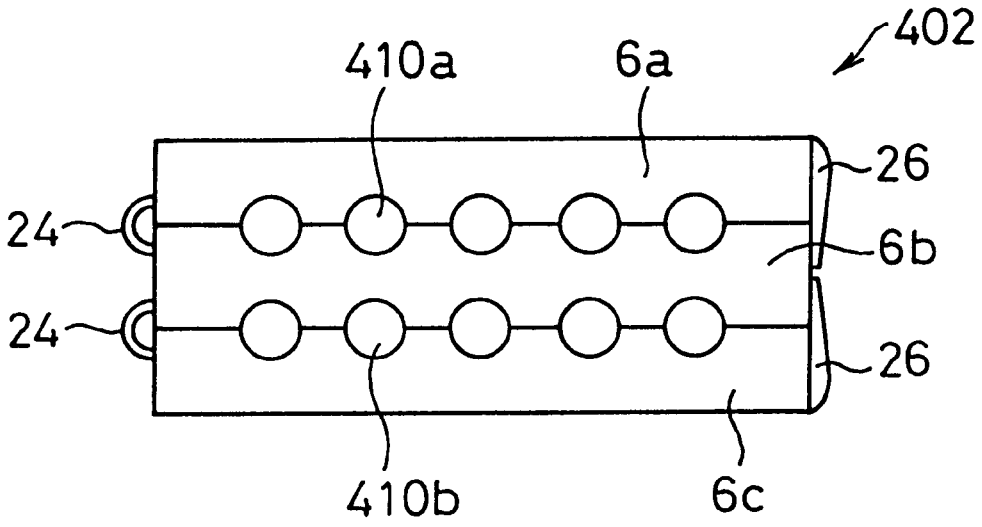
FIGS. 6A and 6B are explanatory views showing modifications of the electric noise absorber.

As shown in FIG. 6A, a further embodiment of an electric noise absorber 402 is illustrated with multiple hollows 410*a* and 410*b*. In this case, the electric noise absorber can be simultaneously attached to multiple electric wires, and the electric noises flowing through the electric wires can be absorbed at the same time.

Figure 6B:
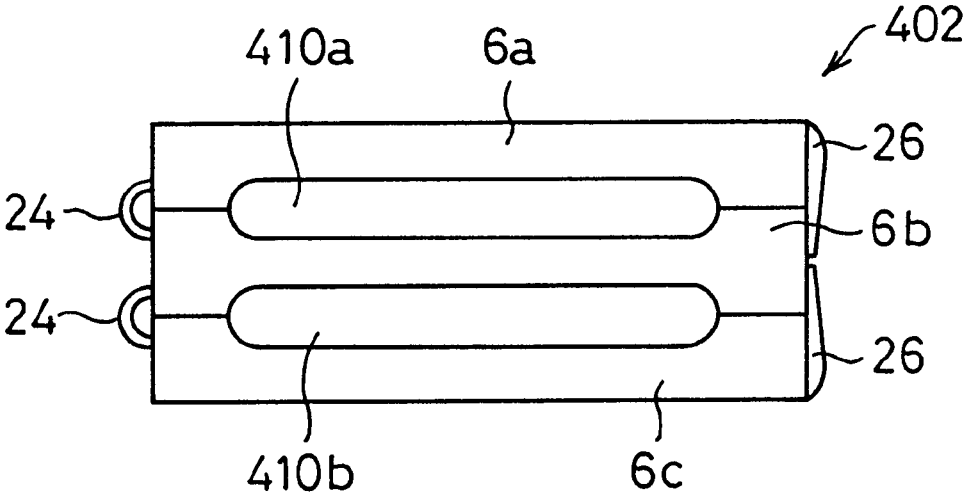

Moreover, the hollow can have various sectional shapes. For example, as shown in FIG. 6B, the hollows 410*a* and 410*b* may be formed to have wide sections. In this case, the electric noise absorber can be attached to a flat cable. The variation of the hollow sectional shape diversifies the types of electric wires to which the electric noise absorber can be attached.

In the first and second embodiments, the hinges 24 are provided on the opposite sides of the second housing section 6*b*, but the present invention is not limited to these embodiments. As shown in FIGS. 6A and 6B, the hinges 24 may be provided on the same side of the second housing section 6*b*.

In the above-described embodiments, the magnetic body parts are contained in housing sections and the magnetic body parts can be reinforced by the housing sections. However, even if the magnetic body parts are not contained in the housing sections, the absorbing characteristics of the electric noise absorber is still enhanced. Therefore, the magnetic body parts provided with the hollows may be attached directly to the electric wire. For example, in an electric noise absorber 502 shown in FIG. 7A, hollows 510*a* and 510*b* are formed in magnetic body parts 504*a* and 504*b* formed of two different magnetic materials, respectively. Electric noises can be effectively absorbed by winding the electric wire around the magnetic body parts 504*a*, 504*b* through the hollows 510*a* and 510*b*. If magnetic body parts 504*a* and 504*b* are formed of different magnetic materials, the superior absorbing ability can be fulfilled for the electric noises in a wide bandwidth.

Figure 7A:
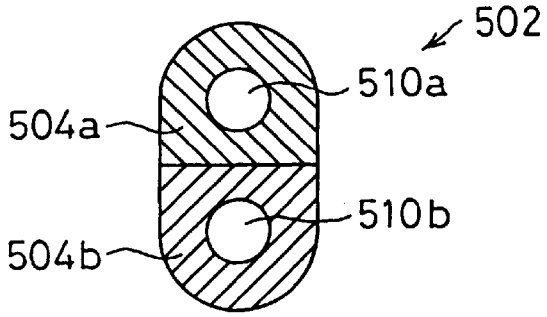
FIGS. 7A to 7D are explanatory views showing modifications of the electric noise absorber.
Figure 7B:
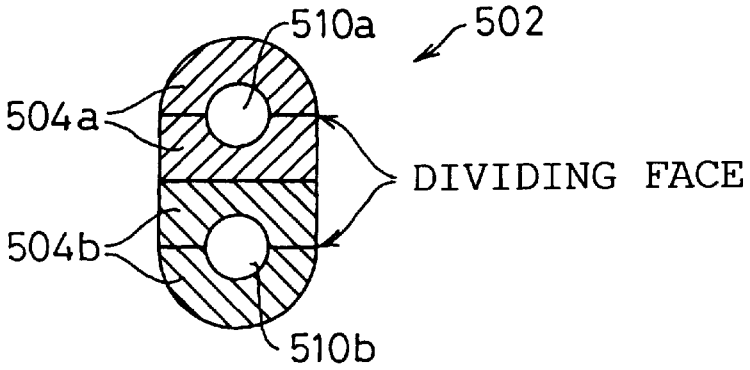
Figure 7C:
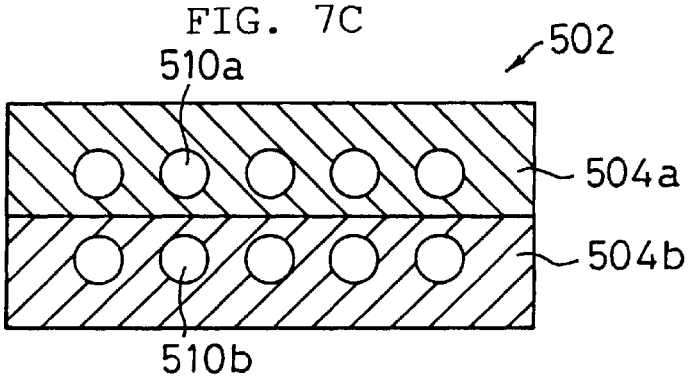
Figure 7D:
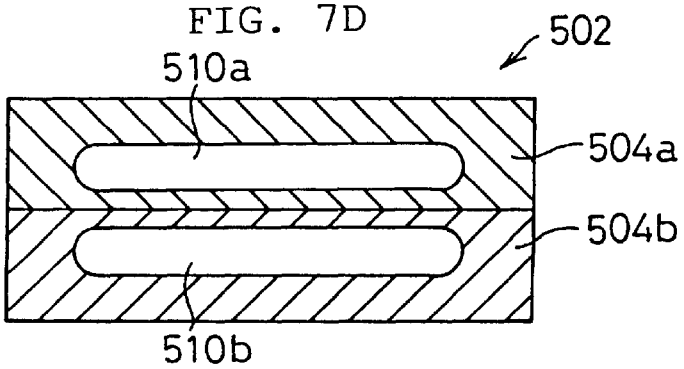

FIG. 7B shows the electric noise absorber 502 of FIG. 7A, in which the magnetic body parts 504*a*, 504*b* are divided by dividing faces extending through the hollows 510*a*, 510*b*, respectively. In this case, after even the already placed electric wire may be wound around the magnetic body pieces between the hollows 510*a* and 510*b*, the divided pieces are connected by the abutting faces, so that the electric noises flowing through the electric wire can effectively be absorbed. Furthermore, as shown in FIG. 7C, a multiplicity of hollows may be formed in the magnetic body parts. By winding a multiplicity of electric wires around the magnetic body portions between the respective hollows 510*a*, 510*b* of the magnetic body parts 504*a*, 504*b*, the electric noises flowing through the electric wires can be simultaneously absorbed. In this case, the electric wire may be wound around the magnetic body portion between the hollows 510*a* (or 510*b*) of the magnetic body 504*a* (or 504*b*). The sectional shape of the hollow is not limited. For example, as shown in FIG. 7D, when the hollow has a flat shape, the electric noise absorber can be attached to a flat cable or other various electric wires.

Additionally, in the embodiments, the electric noise absorbers 2, 102, 202, 302 having the magnetic body parts formed of two types of materials have been described, but the present invention is not limited to the embodiments. The electric noise absorbing characteristic of the wide bandwidth may be enhanced, for example, by combining three or more types of magnetic body parts. The material of the magnetic body is not limited to Mn—Zn ferrite or Ni—Zn ferrite, and the magnetic material may be selected in accordance with the bandwidth of the electric noises to be eliminated.

What is claimed is:

1. A method of using an electric noise absorber, the electric noise absorber having a magnetic body which includes a first, second, and third magnetic body parts, the first and second magnetic body parts defining two open faced hollows forming a first opening and the second and third magnetic body parts defining two open faced hollows forming a second opening, said magnetic body parts defining abutting faces by which the first and the second and the third magnetic body parts are joined to form a single unitary magnetic body; and a housing which includes a first housing part, a second housing part, and a third housing part housing said first, second, third magnetic body parts, respectively, the first and second housing parts being connected with each other by at least one hinge and the second and third housing parts being connected with each other by at least one hinge, each said housing part having openings or notches for allowing an electric wire, which passes through said first and second openings of said magnetic body, to pass therethrough, and locking means for locking said housing parts with each other, the method comprising the steps of:

exposing the hollows of said second magnetic body by releasing said locking means and opening said first and third housing parts relative to said second housing part;

winding the electric wire around said hollows of said second magnetic body;

closing said first and third housing parts against said second housing part; and locking said locking means to ensure formation of the single unitary magnetic body and a magnetic path for absorbing electric noises flowing through the electric wire.

2. An electric noise absorber comprising a magnetic body having a first opening and a second opening extending therethrough to encompass an electric wire extending through both the first and second openings for absorbing electric noise flowing through the electric wire; and the first and second openings being disposed parallel to one another;

wherein the electric noise absorber further comprises a first magnetic body part, a second magnetic body part and a third magnetic body part, the first and the second magnetic body parts define two open faced hollows forming the first opening and the second and the third magnetic body part define two open faced hollows forming the second opening, each of the first, second and third magnetic body parts define abutting faces by which the first and the second magnetic body parts and the second and the third magnetic body parts are joined to form a single unitary magnetic body.

3. The electric noise absorber of claim 2, wherein the magnetic body parts comprise at least two different magnetic materials.

4. The electric noise absorber of claim 2, wherein each of said first and second openings is divided into two open faced hollows by the first, second and third magnetic body parts, and the first, second and third magnetic body parts have abutting faces by which the associated first, second and third magnetic body parts are joined together.

5. The electric noise absorber of claim 2, wherein the first and second openings are each one of circular, semi-circular, and oblong in shape and have at least a partly square transverse cross-section.

6. The electric noise absorber of claim 2, wherein a total of at least three openings, each disposed parallel to one another, are provided in the first, second and third magnetic bodies.

7. The electric noise absorber of claim 2, wherein the first magnetic body part and the third magnetic body part each have a semi-cylindrical transverse cross section, and the first and second openings each have a cylindrical transverse cross section.

8. The electric noise absorber of claim 7, wherein the first and second openings are disposed parallel to one another.

9. An electric noise absorber comprising a magnetic body defined by a plurality of magnetic body parts which together define two parallel openings spaced by magnetic material of at least one of the plurality of body parts, an electric wire extends through both the first and second openings for absorption of electric noise flowing through the electric wire, the plurality of body parts defining abutting faces by which the plurality of body parts are joined together to form a magnetically unitary magnetic body;

wherein the electric noise absorber comprises three magnetic body parts and the first and second openings are spaced from one another by one of the three body parts which defines abutting faces by which the three body parts are joined together to form a magnetically unitary magnetic body.

10. The electric noise absorber of claim 9, wherein the electric noise absorber further comprises a plurality of housing parts which house the three magnetic body parts, the plurality of housing parts ensure connection of mating abutting faces of the body parts in contact with one another and formation of the magnetically unitary magnetic body.

11. The electric noise absorber of claim 10, wherein each of said three magnetic body parts has a corresponding housing part, and the housing parts having cutouts and means for connecting the housing parts together to form an absorber housing with the cutouts coincident with said openings of the three magnetic body parts to facilitate ingress and egress of said electric wire relative to the electric noise absorber.

12. The electric noise absorber of claim 11, wherein each of the body parts and the housing parts are provided with a mating mechanism for captively retaining each of the body parts with a respective housing part.

13. The electric noise absorber of claim 10, wherein the three magnetic body parts and housing parts are provided with mating means for retaining each of the three magnetic body parts in a respective housing part.

14. The electric noise absorber of claim 10, wherein the three magnetic body parts comprise at least two different magnetic materials.

15. The electric noise absorber of claim 9, wherein the first and second openings are disposed parallel to one another and each have an oval transverse cross section for accommodating flat cables.

16. The electric noise absorber of claim 9, wherein the first and second openings are have one of a circular, a semi-circular, and an oblong transverse cross-section.

17. The electric noise absorber of claim 9, wherein each of said first and second openings is divided into two open faced hollows by the first, second and third magnetic body parts, and the first, second and third magnetic body parts have abutting faces by which the associated first, second and third magnetic body parts are joined together.

18. The electric noise absorber of claim 9, wherein the first opening comprises a first plurality of holes spaced from one another which are circular in transverse cross section for accommodating a cylindrical cable and the second opening comprises a second plurality of holes spaced from one another which are circular in transverse cross section for accommodating a cylindrical cable.

19. The electric noise absorber of claim 18, wherein the first plurality of holes and the second plurality of holes are all disposed parallel to one another.

* * * * *